United States Patent [19]

Noshi

[11] Patent Number: 4,610,405

[45] Date of Patent: Sep. 9, 1986

[54] TAKE-UP TUBE SUPPLY SYSTEM IN WINDER

[75] Inventor: Shinji Noshi, Kyoto, Japan

[73] Assignee: Murata Kikai Kabushiki Kaisha, Kyoto, Japan

[21] Appl. No.: 648,646

[22] Filed: Sep. 7, 1984

[30] Foreign Application Priority Data

Sep. 7, 1983 [JP] Japan ..... 58-165595

[51] Int. Cl.[4] ..... B65H 67/04; B65H 54/26

[52] U.S. Cl. ..... 242/35.5 A; 242/35.5 R

[58] Field of Search ..... 242/35.5 A, 35.5 R, 242/35.6 R; 57/268, 269, 270, 271

[56] References Cited

U.S. PATENT DOCUMENTS

| | | | |
|---|---|---|---|
| 3,791,126 | 2/1974 | Kose et al. | 242/35.5 A |
| 3,820,730 | 6/1974 | Endo et al. | 242/35.5 A X |
| 4,066,218 | 1/1978 | Kamp | 242/35.5 A |
| 4,116,395 | 9/1978 | Courvoisier | 242/35.5 A |
| 4,125,990 | 11/1978 | Stahlecker et al. | 242/35.5 A X |
| 4,139,162 | 2/1979 | Stahlecker | 242/35.5 A |
| 4,155,513 | 5/1979 | Maassen | 242/35.5 A |
| 4,178,748 | 12/1979 | Stahlecker et al. | 242/35.5 A X |
| 4,335,859 | 6/1982 | Courvoisier | 242/35.5 A |

FOREIGN PATENT DOCUMENTS

| | | | |
|---|---|---|---|
| 2816418 | 10/1979 | Fed. Rep. of Germany | 242/35.5 A |

*Primary Examiner*—Stanley N. Gilreath

*Attorney, Agent, or Firm*—Spensley Horn Jubas & Lubitz

[57] ABSTRACT

A take-up tube supply system for use in an automatic winder having a plurality of individual winding units arranged into several winding sections with each section taking up a different kind of yarn. The take-up tube supply system includes a plurality of tube supply stations disposed at the ends of each of the winding sections and a doffing truck which moves through each of the various winding sections. A plurality of take-up tube stockers are provided, each respectively associated with one of the respective winding sections. The stockers are adapted to be alternatingly detachable coupled to either the doffing truck or the associated tube supply stations.

15 Claims, 15 Drawing Figures

F
F
ST
10
12a
12b
12c
11a
11b
11c
13
14
15
16
18
19
20
21a
21b
21c
22
23
24a
24b
24c
26
27
28
29
30
33
34

TAKE-UP TUBE SUPPLY SYSTEM IN WINDER

BACKGROUND OF THE INVENTION

The present invention relates to a take-up tube supply system for use in a winder.

In an automatic winder, there have been proposed and operated a variety of auto-doffers in which fully wound packages having wound a predetermined quantity of yarn are taken off from winding units and in which take-up tubes are newly supplied to the units.

In the prior art, however, one winder in which a number of winding units are juxtaposed is of the type for winding up one kind of yarn. It is very difficult to apply the doffer, which is applied to such winder, to the case in which plural kinds of yarns are wound up by means of one winder. In order to efficiently conduct production of multiple kinds and of small quantity, more specifically, one winder is substantially divided into a plurality of winding sections so that yarns of different kinds can be wound up at the respective winding sections.

In this production system, the problem raised when the doffing is to be automated is how take-up tubes especially for the respective sections are supplied to the respective units without being confused with other sections.

SUMMARY OF THE INVENTION

An object of the present invention is to provide a system, which is remarkably effective for enabling automatic doffing of a winder for taking up yarns of plural kinds, and, more particularly, a take-up tube supply system which can also be applied to a winder for taking up a yarn of the same kind.

According to the present invention, there is provided a take-up tube supply system for use in a winder, including a plurality of: take-up tube supply stations disposed at boundaries between sections of a winder substantially divided into a plurality of winding units. A doffing truck made movable through each of each of the various sections of said winder is provided along with a plurality of take-up tube stockers especially for the respective sections. The stockers are configured to be selectively coupled with the take-up tube supply stations and said doffing truck. The doffing truck moves through a particular winding section of the winder while coupled with the stocker especially for that particular winding section. The specific tube stocker can be separated from the doffing truck when the truck moves from that particular section to an adjoining section.

DETAILED DESCRIPTION OF THE INVENTION

The system of the present invention will be described in the following in connection with the embodiments thereof with reference to the accompanying drawings.

Figure 1:
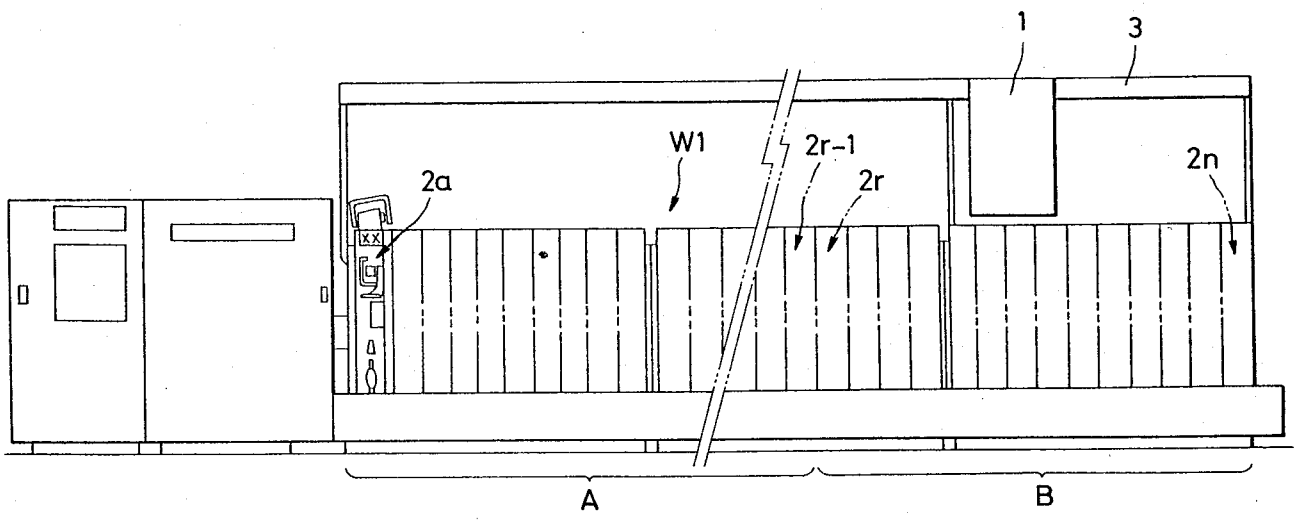
FIG. 1 is a front elevation showing the positional relationship between the winder and the doffing truck.
Figure 2:
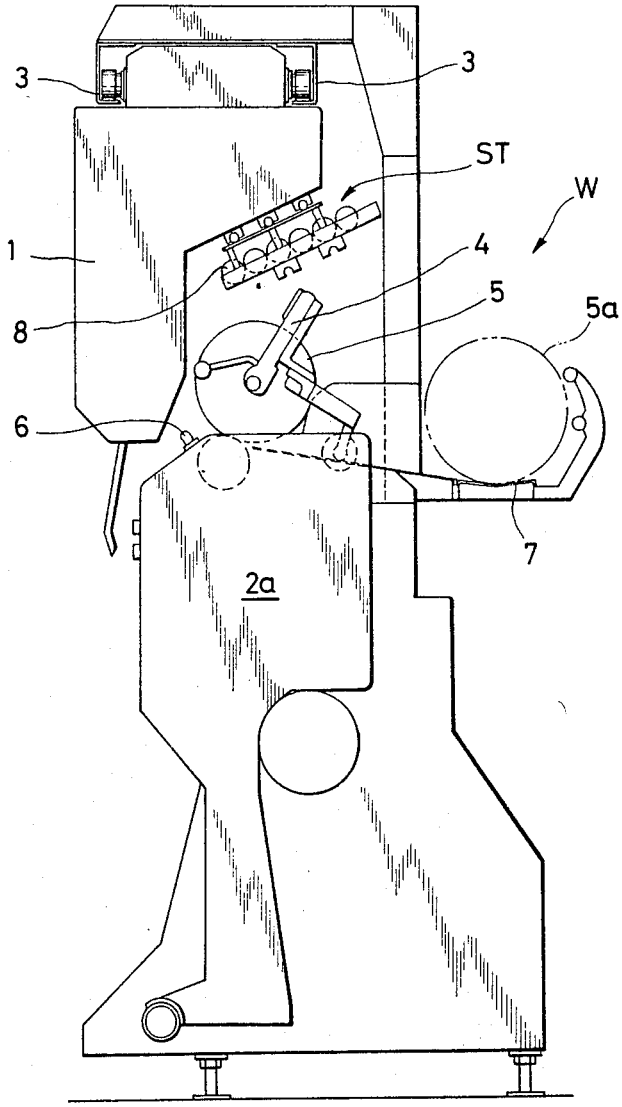
FIG. 2 is a side elevation of the same.

FIGS. 1 and 2 show the relation between a winder W1 and a doffing truck 1. This doffing truck 1 reciprocally runs along ceiling rails 3 and 3 which are laid in the longitudinal direction of the automatic winder W1 having a multiplicity of winding units 2*a* to 2*n* juxtaposed adjacent one another. The aforementioned winder W1 is substantially divided into two sections, i.e., a winding section A, in which the winding units 2*a* to 2*r–l* wind up yarns belonging to kind A, and a winding section in which winding units 2*r* to 2*n* wind up yarns belonging to kind B.

In the aforementioned winding unit, as shown in FIG. 2, when a take-up package 5 supported on a cradle 4 reaches a predetermined quantity of yarn, a full-wound indication lamp 6 is lit so that the doffing truck 1 running detects the aforementioned lamp 6, stops at the position of said unit 2*a*, delivers a fully wound package 5*a* onto a conveyor 7 at the back of the unit, and takes a new take-up tube 8 from a stocker ST at the side of the truck and fits it in the aforementioned cradle 4 thereby to restart the winding and so that the doffing truck 1 continues its run while seeking a unit to be required for a next doffing demand.

The aforementioned stocker ST is one in which a take-up tube especially for the winding section is accommodated at each said section. The stocker ST can be freely united with and separated from the doffing truck 1 and supports the stocker for the section A, while running in the section A, and the stocker for the section B while running in the section B.

Figure 3:
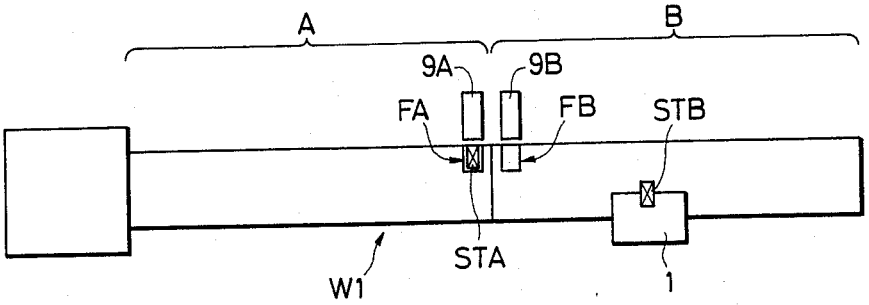
FIG. 3 is a layout showing one embodiment of the system of the present invention.

In FIG. 3, there is schematically shown the relationship among the aforementioned section, the doffing truck and the stocker. At the connection between the winding sections A and B, more specifically, there are arranged take-up tube supply stations FA and FB, on which are placed stockers STA and STB for the respective sections so that they are supplied with the take-up tube from take-up tube supply devices 9A and 9B. As a result, while the truck 1 is running in the section B, the stocker STB is united with the truck and transferred together. While the stocker STB is joined with the truck 1, the stocker STA may be supplied with additional take-up tube at the station FA. When the truck 1 is transfered from the section B to the section A, the stocker STB which was coupled with the truck 1 while the latter was traveling in section B of the winder is separated and placed on the station FB and the truck 1 is then united with the stocker STA of the station FA so that the combined truck 1 and stocker STA can run in the section A.

Figure 4:
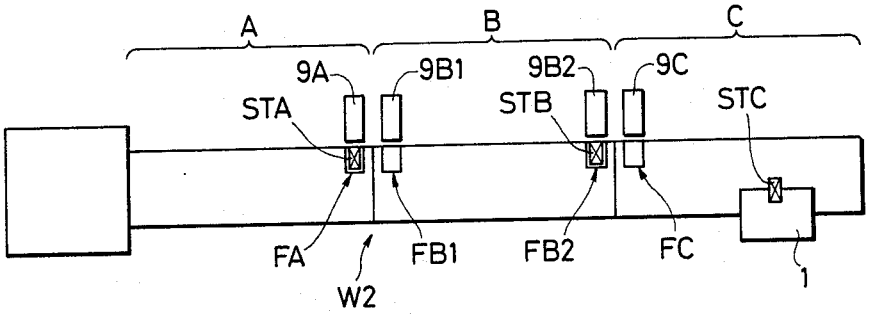
FIG. 4 is a layout showing another embodiment.
Figure 5:
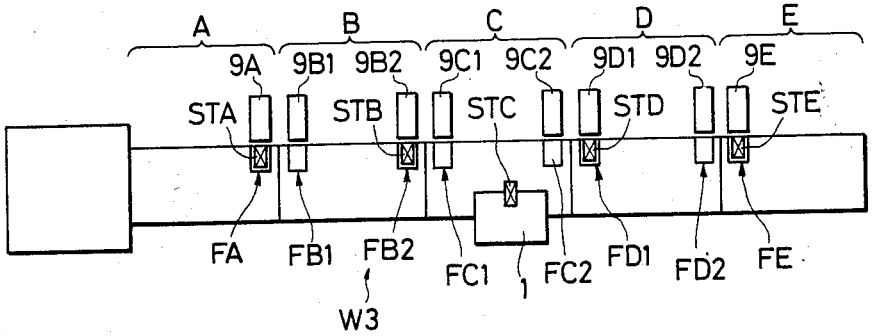
FIG. 5 is a layout showing still another embodiment.

FIGS. 4 and 5 show the relationships among the take-up tube supply station, the stocker and the truck, respectively, in case the winder is divided into three section and in case the wider is divided into five sections.

As shown in FIG. 4, more specifically, a winder W2 is divided into three sections A, B and C. In case yarns of different kinds are to be taken up at the respective sections, take-up tube stockers STA, STB and STC especially for the respective sections are prepared, and take-up tube supply stations FA, FB1, FB2 and FC are disposed at the connections of the respective sections. In this case, the supply stations FB1 and FB2 are disposed at both the ends of the central section B. In case the truck 1 runs leftward from the shown position, more specifically, the winding unit can be supplied with the take-up tube even during the leftward run of the truck 1 in the section B, if the stocker STC is united with the stocker STB on the station FB2 at the left end of the section B immediately after it is separated at the left end of the section C and placed on the station FC. As a result, when the left end of the section B is reached, the stocker STB reciprocates from the section A, if it is placed on the station FB1, and is placed in advance on the station FB1 in the section B when in the rightward run so that it is united with the truck, whereby the winding unit can be supplied with the take-up tube even when in the rightward transfer in the section B. Moreover, take-up tube supply devices 9A to 9C are arranged at the stations FA to FC, respectively, like the aforementioned arrangement.

FIG. 5 corresponds to the case in which a winder W3 is divided into five sections A to E. Like the foregoing arrangement, the sections at both the ends are equipped with supply stations FA and FE, respectively, and the sections B to D at the intermediate portions are equipped with two supply stations FB1 and FB2, FC1 and FC2, and FD1 and FD2, respectively. The stockers are disposed at the sections, respectively, so that totally five stockers STA to STE are used.

From the foregoing relationships of FIGS. 3 to 5, therefore, the stockers are n in number if the number of the winding sections is set at n, and one doffing truck can effectively conduct the take-up tube supply if the supply stations are disposed at $2(n-1)$ positions.

Next, the stockers and the take-up tube supply stations to be applied to the aforementioned system will be explained in connection with the embodiments thereof with reference to FIGS. 6 to 9. Incidentially, the individual stockers are represented by reference letters ST, and the individual supply stations are represented by reference letter F.

The stocker ST is constructed of: a take-up tube accommodating box 10; joint blocks 11*a*, 11*b* and 11*c* which are disposed below said accommodating box and adapted to be engaged with or disengaged from the supply station; and joint pins 12*a*, 12*b* and 12*c* which are disposed above the accommodating box and adapted to be engaged with or disengaged from the doffing truck.

The aforementioned take-up tube accommodating box 10 is constructed of a bobbin placing plate 13, both side plates 14 and 14, and stopper members 15 and 15 at the leading ends. The placing plate 13 has its take-up tube feeding position notched at 16, in which are disposed feeding members 18 and 18 biased clockwise on a pin 17 of FIG. 6. As a result, when the take-up tube 8*a* at the foremost end of the aforementioned accommodating box is to be started, a chucker member disposed at the side of the doffing truck chucks the take-up tube 8*a* from above or below to turn the take up tube 8*a* while pushing the starting member 18 counter-clockwise away from the take up tube 8*a* thereby to start the single take-up tube 8*a* in the winder. To the lower portion of the aforementioned accommodating box 10, moreover, there is fixed a bracket 19 having its lower face, to which the joint blocks 11*a*, 11*b* and 11*c* are fixed at three positions by means of screws or by the welding operation. The aforementioned joint blocks 11*a* to 11*c* are formed with engagement grooves 20 which extend in parallel with the running direction of the truck allowing the blocks 11*a* to 11*c* to advance onto and engage with a set of holder pins 21*a* to 21*c* located at the supply station side shown FIG. 9 closest to the truck 1. At an upper portion of the aforementioned stocker ST, moreover, there is fixed through posts 22 and 22 a bracket 23 to which are fixed at three positions the joint pins 12*a*, 12*b* and 12*c* adapted to be freely united with or separated from holder blocks 24*a* to 24*c* at the truck side.

Figures 7, 8, 9:
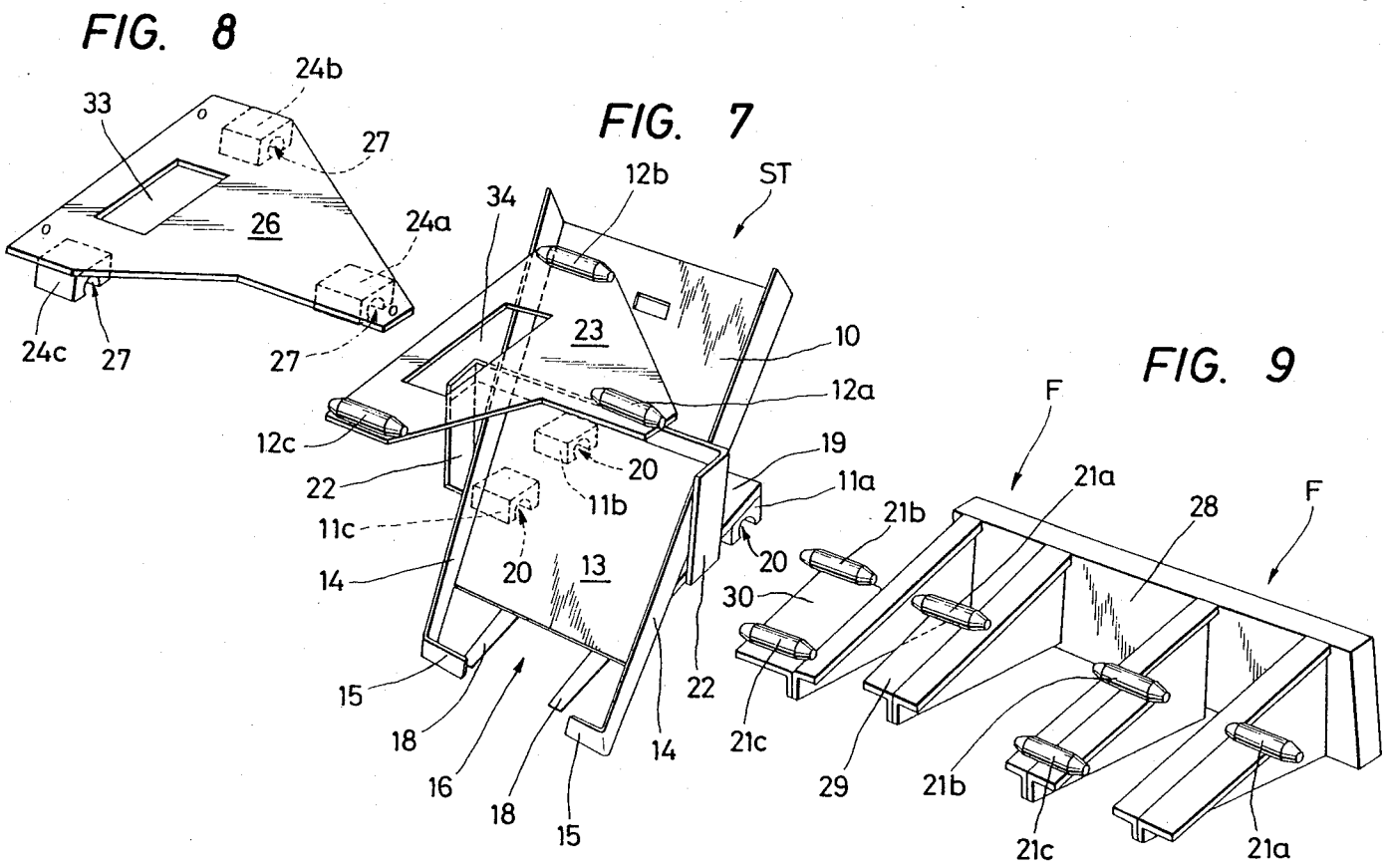
FIG. 7 is a perspective view showing one example of the stocker.
FIG. 8 is a perspective view showing one example of the uniting and separating mechanism for the stocker disposed at the truck side.
FIG. 9 is a perspective view showing the stocker placing mechanism disposed at each station.

The aforementioned joint pins 12*a* to 12*c* are arranged like the joint blocks in parallel with the running direction of the truck and can be engaged with or disengaged from the holder blocks 24*a*, 24*b* and 24*c* at the truck side of FIG. 8.

Figure 6:
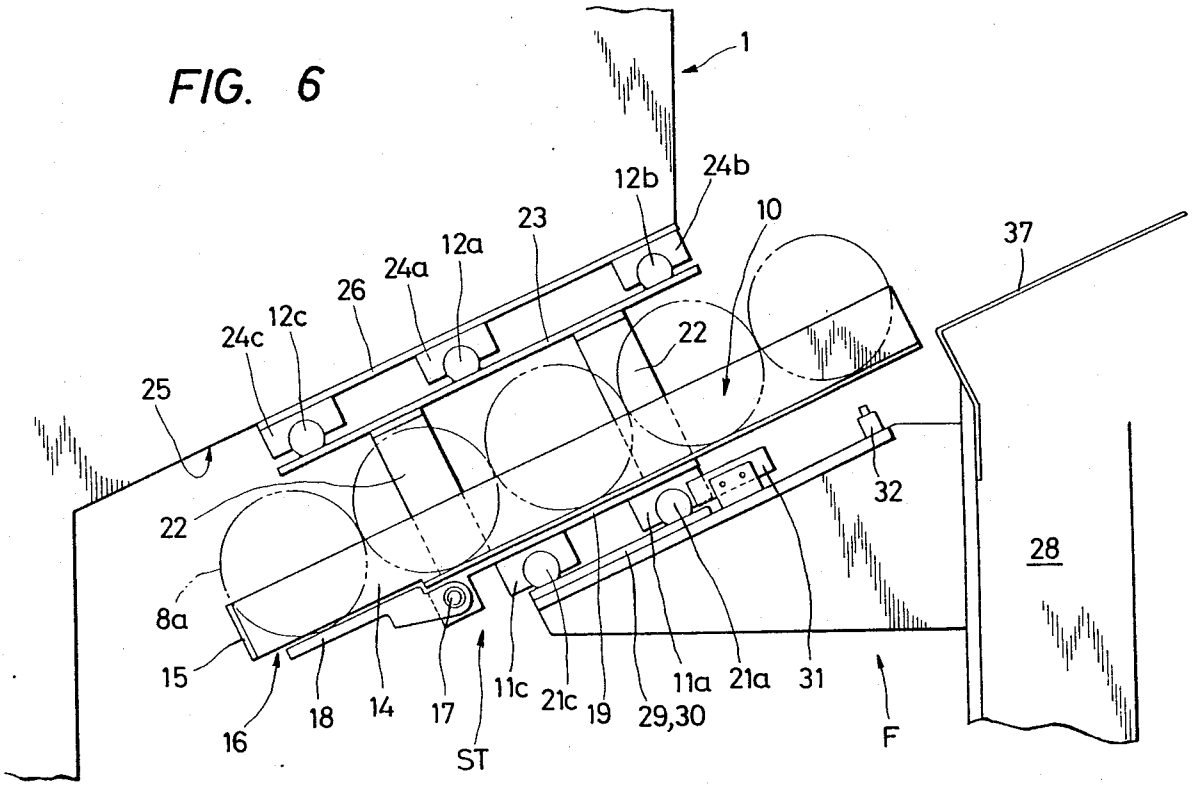
FIG. 6 is a side elevation showing the relationship among the truck, the stocker and the take-up tube supply station.

As shown in FIGS. 6 and 8, on the other hand, there are integrally fixed to the sloped face 25 of the truck 1 a plate 26 and the holder blocks 24*a* to 24*c* which in turn are fixed to the three positions of said plate 26. The aforementioned holder blocks 24*a* to 24*c* are formed with engagement grooves 27, which extend in parallel with the running direction of the truck, like the joint blocks 11*a* to 11*c* which are disposed at the stocker ST. As shown in FIGS. 6 and 9, moreover, at the take-up tube supply station F, there are fixed on brackets 29 and 30, which are fixed to a stationary frame 28, the holder pins 21*a* to 21*c* which are engaged with the joint blocks 11*a* to 11*c* of the stocker ST.

Incidentally, the shapes of the grooves of the joint blocks 11*a* to 11*c*, which are formed in the aforementioned stocker ST and station F, and the holder pins 21*a* to 21*c* are exemplified by a circular shape in section, as shown, but may have another sectional shape if they are engaged with each other in a dovetail form. The aforementioned relationship similarly applies to the joint pins 12*a* to 12*c* at the side of the stocker ST and the holder blocks 24*a* to 24*c* at the side of the truck. As shown in FIG. 6, moreover, the mounting positions of the individual holder pins at the station side, the individual holder blocks at the truck side, and the individual joint pins and joint blocks above and below the stocker are so set that the center lines of the pin 21*a* and the corresponding groove of the block 11*a* may be aligned with each other. As a result, the side view of FIG. 6 is expressed in any case in the state, in which the stocker ST is placed on the station F, in which the stocker ST is united with the truck 1, or in which both the stocker ST and the truck 1 are positioned at the station F. Incidentally, indicated at reference numeral 31 in FIG. 6 is a contactless sensor which is fixed to the station side for detecting that the end face of the joint block 11*a* of the stocker comes close and is placed in a predetermined position. A photoelectric sensor 32 is used for detecting whether or not the tube at the rearmost end of the stocker is present. The station shown in FIG. 9 is arranged at the connection of each winding section of FIGS. 3 to 5. Apertures 33 and 34 may be respectively formed in the plate 26 and bracket 23 to permit the beam of a sensor (not shown) on the truck side to transmit therethrough.

Figure 10:
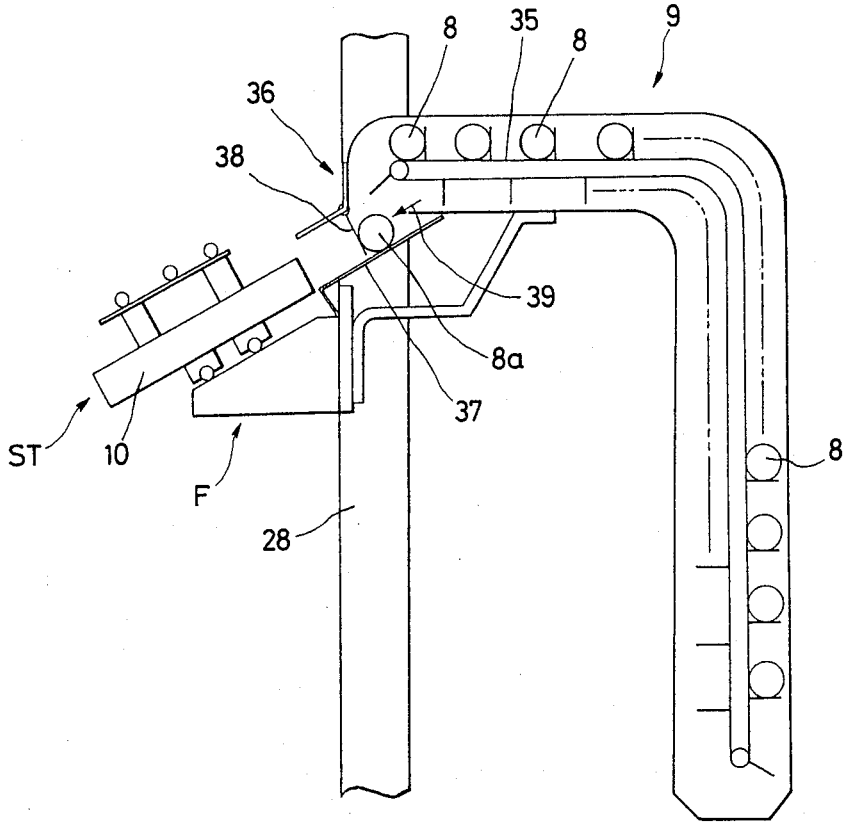
FIG. 10 is a side view schematically showing the construction of one example of the take-up tube supply device.

FIG. 10 shows one example of the take-up tube supply device 9 which is disposed at each station F for supplying the take-up tube to the stocker ST. Said device is constructed of a take-up tube carrier conveyor 35, and a take-up tube feeder 36. The take-up tube 8 to be conveyed at a pitch by the conveyor 35 drops from the horizontal end portion and stands by at a position in which a guide plate 37 and a movable guide plate 38 abut against each other. When the stocker ST is placed in the predetermined position of the station F and when the sensor 32 of FIG. 6 detects absence of the take-up tube, the take-up tube 8*a* is slid on the guide plate 37, while turning the guide plate 38, by a not-shown pusher such as a push rod, which is adapted to protrude in the direction of arrow 39 by the drive of such a link mechanism as is made coactive with the run of the conveyor 35, until it is accommodated in the accommodating box 10 of the stocker. Incidentally, in case the take-up tube 8 is a taper tube, the aforementioned pushing action is effective. In the case of a cheese packaging tube, however, it is sufficient to provide a sloped guide. The take-up tube supply device thus constructed is disposed at the positions of the stations FA and FB in the case of FIG. 3. It is quite natural that the take-up tubes for each section be accommodated in the take-up tube supply station for said station.

In the system having the individual devices thus far described, the take-up tube supplying operations will be described in the following.

Figure 11:
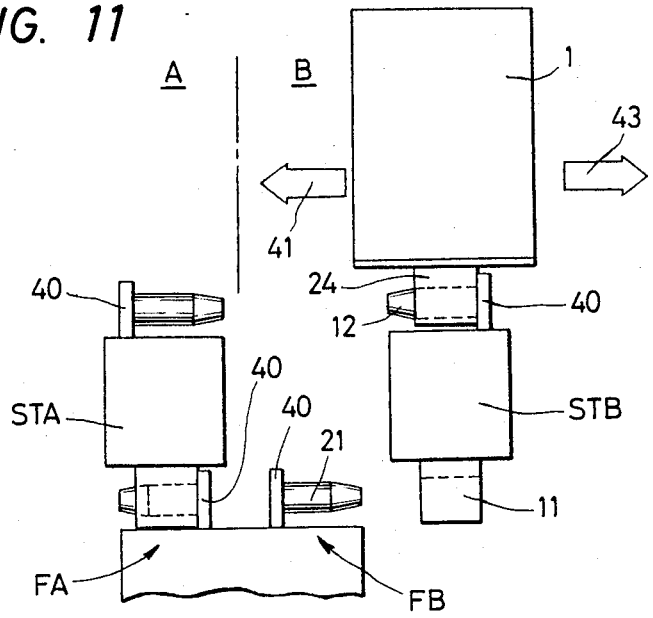
FIGS. 11 to 13 are views showing the method of detachably coupling the stocker to the truck and the tube supply station of the system shown in FIG. 3.

A first description will be made in case the winder is divided into the two sections A and B, as shown in FIG. 3. In this case, the holder pins to be disposed at the station side and the joint pins to be disposed at the stocker side are exemplified by applying the pins, each of which has its one-side end face flanged at 40, as shown in FIG. 11, in place of the pins 12*a* to 12*c* and 21*a* to 21*c* shown in FIGS. 7 and 9. Other joint blocks and holder blocks are similar to those of FIGS. 7 and 9.

In FIGS. 3 and 11, more specifically, the stocker STB especially for the section B is conveyed, while being united with the truck 1 which is either running in the section B or doffing, to supply the take-up tubes as necessary to the individual winding units in section B of the winder. At the same time the stocker STA disposed at the supply station FA of the section A is supplied with the appropriate type of take-up tubes for the type of yarn being taken up in section A by the aforementioned take-up tube supply device 9A so that the stocket STA is fully loaded and ready for use. When the truck 1 running in the direction of arrow 41 reaches the left end portion of the section B, as shown in FIG. 11, the joint block 11 of the stocker STB comes into engagement with the holder pin 21 at the station side. When the truck runs across a boundary in the direction of arrow 41, moreover, the block 11 of the stocker STB comes into abutment against the flanged portion 40 of the pin 21 of the station FB so that the stocker STB is halted at the station of said station FB. On the other hand, the holder block 24 at the side of the truck 1 comes out of the joint pin 12 of the stocker STB to release the unit of the truck 1 and the stocker STB and separate them.

Figure 12:
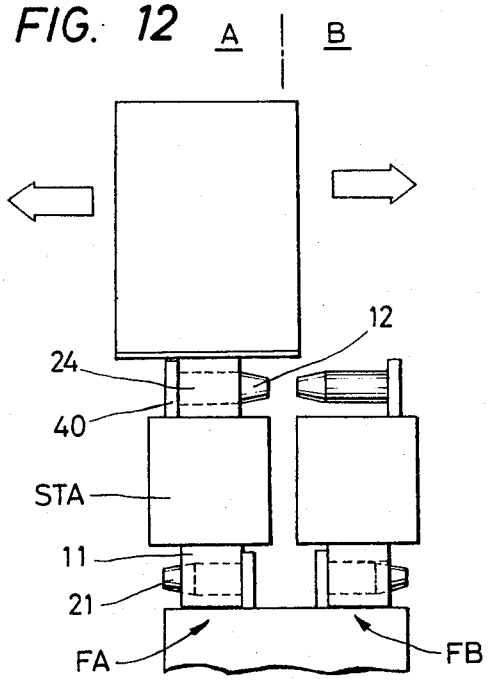
Figure 13:
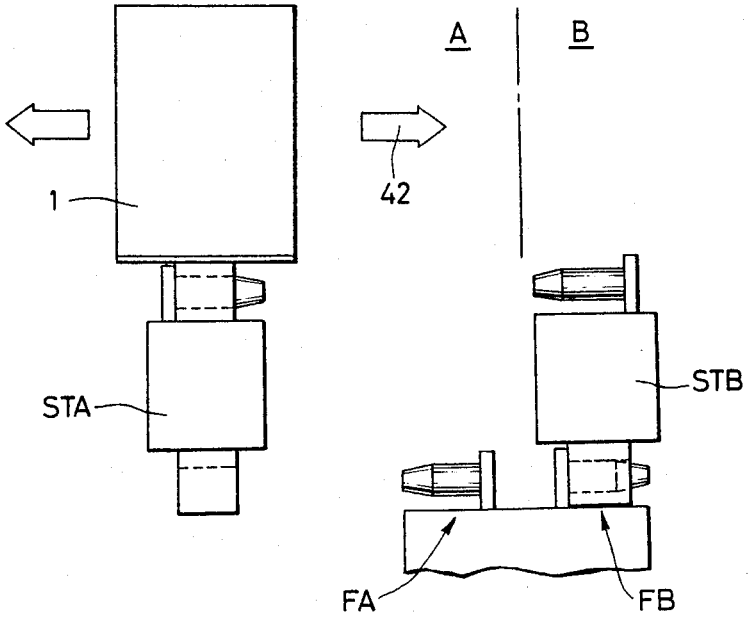

When the truck 1 subsequently reaches the position of the station FA of the section A, as shown in FIG. 12, the holder block 24 at the truck side comes into engagement with the joint pin 12 of the stocker STA, and the block 24 has its end face abutting against the flanged portion 40 of the pin 12 in accordance with the run of the truck so that the stocker STA is united with the truck 1 whereas; the joint block 11 below the stocker STA is disengaged from the holder pin 21 of the station FA. In other words, the state of FIG. 13 is initiated, in which the truck 1 runs in the section A in the state, in which it is united with the stocker STA especially for the section A, and is stopped at the position of the winding unit having a doffing demand to conduct the doffing operation and the take-up tube supply. When the truck 1 having reciprocated in the section A runs in the direction of arrow 42 to reach the connection between the sections A and B, the operations, opposite to the aforementioned ones are conducted such that the state of FIG. 13 is changed through that of FIG. 12 to that of FIG. 11 so that the truck 1 runs again in the section B in the direction of arrow 43.

More specifically, all that the doffing truck 1 does is to run the winder W1 of FIG. 3 reciprocally to the right and left. The truck 1 carries the take-up tube stocker STA especially for the section A while running in the section A but carries the stocker STB especially for the section B while running in the section B. Each winding unit is supplied with the take-up tube therefor without any confusion with the take-up tubes of other kinds. Moreover, it is unnecessary to provide each winding unit with a stock device such as the take-up tube storage magazine. During the doffing operation at one section, on the other hand, the stocker at the other section is supplied with the take-up tubes. As a result, it does not take much time for the truck to stand by at the position of the supply station, but the take-up tubes of different kinds can be supplied by the reciprocal runs along the winder like the doffing truck which is applied to the ordinary winder for taking up only one kind.

Incidentally, FIG. 3 exemplifies the case in which the yarns of two kinds are taken up by the single winder. However, the aforementioned take-up tube supply system can be applied as it is without any change to the winder for winding the yarn of one kind. As shown in FIG. 3, more specifically, in case the winder W1 is constructed of a multiplicity of winding units, the number of the take-up tubes to be accommodated in one stocker ST is limited so that the take-up tubes disappears in the stocker midway of the one-way run of the truck. Even at the winder W1 for one kind, therefore, the aforementioned disadvantage is eliminated by conveniently dividing the winder W1 into the two sections A and B or more and by providing each section with the take-up tube supply station. By accommodating the take-up tubes of the same kind in the stockers STA and STB of FIG. 3, more specifically, the winder having a multiplicity of winding units can be used as one for one kind. Moreover, only one doffing truck suffices the system.

Incidentally, in case the winder is divided into the three or more sections shown in FIGS. 4 and 5, the unit and separation of the stocker cannot be effected merely by the use of the pin having the flanged portion, as shown in FIGS. 11 to 13. At each station position, therefore, it is necessary to make a difference between the engaging force between the block 11*a* of the stocker of FIGS. 7 to 9 and the pin 21*a* at the station side and the engaging force between the pin 12*a* of the stocker and the block 24*a* at the truck side by any operation. When the stocker supported on the truck is to be dropped onto the station, more specifically, the frictional force between the block 11*a* of the stocker and the pin 21*a* at the station side is made stronger than that between the block 24 at the truck side and the pin 12*a* at the stocker side in accordance with the run of the truck so that the block 24 of the truck comes out of the pin 12 of the stocker and is separated while the stocker is being placed on the station. In order to effect the operations described above, as shown in FIG. 14, there is provided either a movable pin 44 which extends through the pin 21 at the station side to be forced into contact or engagement with the block 11 of the stocker ST or a movable pin 45 which extends through the holder 24 at the side of the truck 1 to be forced into contact or engagement with the pin 12 of the stocker. As a result, in case the stocker ST on the station F is to be united with the truck 1, the block 11 at the side of the stocker ST can pass over the pin 21 at the side of the station F and can be carried in the state, in which the stocker is united with the truck, if the truck is moved to the left or right from the position of FIG. 14 with only its pin 45 protruding.

Figure 15:
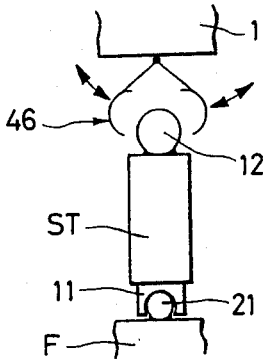
FIG. 15 is a side elevation showing another example of the same.
Figure 14:
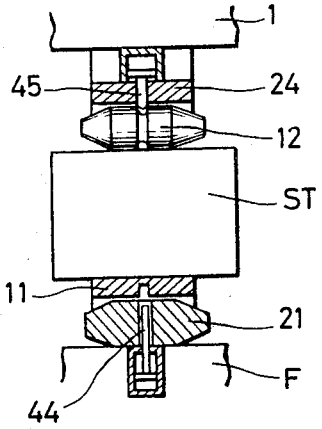
FIG. 14 is a sectional front elevation showing one example of a detachable coupling mechanism for the stocker which may be employed in the systems shown in FIGS. 4 and 5.

Alternatively, as shown in FIG. 15, if the truck 1 is provided with an openable chucker 46 in place of the holder block, attachment to and detachment from the station are arbitrary. Incidentally, if the uniting and separating mechanism shown in FIGS. 14 and 15 is applied, the take-up tube supply system similar to the foregoing one can be practised in the winders shown in FIGS. 4 and 5. If the movable pin engagement mechanism illustrated in FIG. 14 or the openable chucker mechanism illustrated in FIG. 15 are employed in stocking the winders shown in FIGS. 4 and 5, the truck 1 should briefly stop at each station in order to be properly positioned with respect to the stocker or the station.

In the system of FIG. 4, more specifically, when the truck 1 running from the right to the left in the section C reaches the station FC, the stocker STC thereon is separated and placed on the station FC. The truck having run farther to the left enters the section B and is united with the stocker STB for the section B on the station FB2 so that it is moved together to effect the doffing operation and the take-up tube supply in the section B. When in the subsequent transfer from the section B to the section A, the stocker STB united with the truck is also separated and placed on the station FB1, and the truck is united with the stocker STA for the section A to move in the section A.

In the system of FIG. 5, too, like the system of FIG. 4, the stockers STA to STE especially for the respective sections are given and taken temporarily among the trucks in accordance with the runs of the trucks so that the take-up tubes especially for the respective sections are supplied to a predetermined winding unit.

As has been described hereinbefore, according to the present invention, there is provided the take-up tube supply system for use in the winder, comprising: the take-up tube supply stations disposed at such winding sections of the winder, respectively, as are substantially divided into plurality; the doffing truck made movable through each section of said winder; and the take-up tube stockers carrying tubes configured especially for the respective sections of set winder with the stockers adapted to be alternatively detachably coupled with both said take-up tube supply stations and said doffing trucks. As a result, even in case yarns of multiple kinds are to be taken up by a single winder, the individual winding units can be supplied with the take-up tubes having predetermined sizes and shapes without any confusion with other take-up tubes merely by running the single doffing truck along the winder.

Moreover, it is unnecessary to provide the individual winding units with the take-up tube storage magazines. The take-up tubes supply operations can be efficiently conducted by providing the group, i.e., section of the winding units with the take-up tube supply station.

Still moreover, the present system can be applied not only to the winder for taking up yarns of multiple kinds but to the winder for taking up a yarn of one kind thereby to provide a remarkably flexible system for automatically carrying and supplying the take-up tubes.

What is claimed is:

1. A take-up tube supply system for use in an automatic winder having a plurality of winding sections, comprising:

a truck attached to said winder, said truck being capable of transit through more than one of said winding sections, a plurality of take-up tube stockers, each of said stockers being associated with one of said winding sections, each of said stockers being capable of retaining one or more take-up tubes, means for engaging said truck and said stocker when said truck enters said winding section associated with said stocker;

means for disengaging said truck and said stocker when said truck exits said winding section associated with said stocker;

wherein said truck is engaged with said stocker associated with said winding section when said truck is in transit through said winding section.

2. A take-up tube supply system for use in a winder having a plurality of winding sections, comprising:

a plurality of take-up tube supply stations, each of said winding sections being associated with at least one of said supply stations;

a truck movable through each of said winding sections;

a plurality of take-up tube stockers, each said stockers being associated with one of said winding sections, means for engaging said truck and said stocker when said truck enters said winding section associated with said stocker;

means for disengaging said truck and said stocker when said truck exits said winding section associated with said stocker;

whereby said truck moves through each of said winding sections while being united with said take-up tube stocker associated with that winding section.

3. A system as claimed in claim 2, further comprising:

a plurality of take-up tube supply devices, each of said supply devices disposed adjacent one of said supply stations, said supply devices supplying take-up tubes to said take-up tube stockers when said tube stockers are positioned adjacent said take-up tube supply stations.

4. A system as claimed in claim 3, wherein said winder has at least three adjacent winding sections, and wherein each intermediate winding section has two of said take-up tube supply stations associated therewith.

5. A system as claimed in claim 2, wherein each of said take-up tube stockers comprises:

a take-up tube accommodating box for storing a plurality of take-up tubes;

a plurality of joint blocks disposed below said accommodating box and positioned to engage a portion of an associated supply station; and a plurality of joint pins disposed above said accommodating box and positioned to engage a portion of said truck.

6. A system as claimed in claim 5, wherein said take-up tube accommodating box comprises:

a take-up tube placing plate, a plurality of side plates, and at least one stopper member disposed adjacent the perimeter of said accommodating box.

7. A system as claimed in claim 5, further comprising:

a plurality of holder blocks disposed on said truck, said holder blocks having engagement grooves therein oriented parallel to the direction of travel of said truck, and a plurality of holder pins disposed on said supply stations, said holder pins being oriented parallel to the direction of travel of said truck, said engagement grooves disposed in said holder blocks being configured to engage said joint pins of said accommodating box, and said holder pins disposed on said supply stations being configured to engage said joint blocks of said accommodating box.

8. A system as claimed in claim 7, wherein at least one of said holder pins disposed on the supply stations has a flanged portion and at least one of said joint pins disposed on the take-up tube stocker has a flanged portion.

9. A system as claimed in claim 7, further comprising:

a plurality of first movable pins each separately extending through the holder pins at the supply stations, said first movable pins capable of being moved into contact with one of the joint blocks of the take-up tube stockers, and a plurality of second movable pins each separately extending through the holder blocks at the truck, said second movable pins capable of being moved into contact with one of the joint pins of the take-up tube stocker.

10. A system as claimed in claim 7, wherein said truck is provided with an operable chucker engaging means for engaging one of said joint pins of said tube stocker.

11. A system as claimed in claim 5, further comprising:

a first sensor adjacent said supply station for detecting the presence of a joint block of the take-up tube stocker and a second sensor adjacent said supply station for detecting the presence of a take-up tube at a predetermined location within said take-up tube stocker.

12. A system as claimed in claim 8, wherein said take-up tube supply device comprises: a take-up tube feeder positioned adjacent said supply station, said take-up tube feeder including a fixed guide plate, a movable guide plate and a take-up tube pushing means for pushing said take-up tube; a take-up tube conveyor for delivering take-up tubes to said take-up feeder; and a sensor for detecting the presence of a take-up tube in said supply station.

13. A take-up tube supply system comprising:

a winder having a plurality of winding sections;

a plurality of stockers, each of said stockers being associated with one of said winding sections, each of said stockers being capable of retaining one or more take-up tubes;

a truck capable of transit through more than one of said winding sections;

means for engaging said truck and said stocker when said truck enters said winding section associated with said stocker;

means for disengaging said truck and said stocker when said truck exits said winding section associated with said stocker;

whereby said truck and said stocker move in unity when said truck is in transit through said winding section associated with said stocker.

14. A device as in claim 13 further comprising:

a plurality of supply stations for supplying take-up tubes to said stockers, each of said winding sections being associated with at least one of said supply stations.

15. A device as in claim 14 further comprising:

means for engaging said stocker and said supply station when said truck exits said winding section associated with said stocker;

means for disengaging said stocker and said supply station when said truck enters said winding section associated with said stocker;

whereby said stocker is positioned to receive take-up tubes from said supply station when said truck is not in transit through said winding section associated with said stocker.

* * * * *